US005495141A

United States Patent [19]

Thomas

[11] Patent Number: 5,495,141

[45] Date of Patent: Feb. 27, 1996

[54] COLLIMATOR APPLICATION FOR MICROCHANNEL PLATE IMAGE INTENSIFIER RESOLUTION IMPROVEMENT

[75] Inventor: Stanley W. Thomas, Livermore, Calif.

[73] Assignee: The Regents of the University of California, Oakland, Calif.

[21] Appl. No.: 196,405

[22] Filed: Feb. 15, 1994

[51] Int. Cl.[6] ..... H01J 31/50

[52] U.S. Cl. ..... 313/528; 313/524; 313/525

[58] Field of Search ..... 313/365, 524, 313/525, 526, 527, 528, 529, 530, 532, 542, 103 R, 103 CM, 105 CM; 250/214 VT

[56] References Cited

U.S. PATENT DOCUMENTS

| | | | |
|---|---|---|---|
| 4,120,002 | 10/1978 | Lieber | 358/313 |
| 4,220,975 | 9/1980 | Lieber et al. | 313/358 |
| 4,374,325 | 2/1983 | Howorth | 313/524 |
| 4,550,251 | 10/1985 | Zitelli | 313/105 CM |
| 4,625,106 | 11/1986 | Bender et al. | 250/313 |

*Primary Examiner*—Sandra L. O'Shea
*Assistant Examiner*—Vip Patel
*Attorney, Agent, or Firm*—Henry P. Sartorio; John P. Wooldridge

[57] ABSTRACT

A collimator is included in a microchannel plate image intensifier (MCPI). Collimators can be useful in improving resolution of MCPIs by eliminating the scattered electron problem and by limiting the transverse energy of electrons reaching the screen. Due to its optical absorption, a collimator will also increase the extinction ratio of an intensifier by approximately an order of magnitude. Additionally, the smooth surface of the collimator will permit a higher focusing field to be employed in the MCP-to-collimator region than is currently permitted in the MCP-to-screen region by the relatively rough and fragile aluminum layer covering the screen. Coating the MCP and collimator surfaces with aluminum oxide appears to permit additional significant increases in the field strength, resulting in better resolution.

9 Claims, 1 Drawing Sheet

COLLIMATOR APPLICATION FOR MICROCHANNEL PLATE IMAGE INTENSIFIER RESOLUTION IMPROVEMENT

The United States Government has rights in this invention pursuant to Contract No. W- 7405-ENG-48 between the United States Department of Energy and the University of California for the operation of Lawrence Livermore National Laboratory.

BACKGROUND OF THE INVENTION

1. Field of the Invention

The present invention relates to microchannel plate image intensifiers (MCPIs) and more specifically, to the use of a collimator to improve the resolution of proximity-focused MCPIs.

2. Description of Related Art

Image intensifier tubes are electro-optical devices which are used to detect, intensify and shutter optical images from the near ultraviolet to the near infrared regions of the electromagnetic spectrum. They are used for intensifying weak images for night vision and night blindness, for astronomy, electron microscopy, medical research, radiology, and as high-speed light shutters. Image tubes are also used for intensifying an image and as "active" light shuttering devices, permitting very short exposure times.

A proximity focused, MCP intensifier tube consists of an evacuated enclosure containing an image sensor (a photocathode) for conversion of an incident radiant image to a low-energy electron image, a proximity-focusing electron lens for focusing the electron image, a microchannel plate (MCP) for amplifying the electron image current, a second proximity focusing lens and a phosphor screen for conversion of the electron image to a light image.

It is estimated that about 20% of the electrons from the cathode are elastically scattered when they hit the MCP input surface. They rebound, are repelled by the cathode-to-MCP electric field and strike the MCP surface a second time at a distance of up to twice the cathode-to-MCP spacing from the first impact, or within a circle of about 800 microns diameter on the MCP input surface. In the screen region the same phenomenon occurs, but the spacing is about 1.2 mm so that the circle diameter on the screen is about 5 mm. With 20% of the electrons from an initial spot size of 50 microns, for example, distributed in some fashion over a 20 mm square area, the density is fairly low. In fact, the spot spreading effect is seen at amplitudes of about three orders of magnitude below the peak. This results in crosstalk, which becomes important when a bright signal is located adjacent to a weak signal, as when spatially multiplexing several inputs on a streak camera cathode.

The intensifier tube uses a microchannel plate for internal current multiplication. A microchannel plate is a two-dimensional array of hollow glass fibers, fused together into a thin disk. The inside surface of the hollow glass fibers is covered by a resistive secondary electron emission film, which is electrically connected to the input and the output electrodes of the channel plate. The hollow glass fibers, generally termed microchannels, have an inside diameter in the 8- to 12 μm range. The microchannels are not perpendicular to the input and output surfaces but typically are at a 5- to 10 degree bias angle. The purpose of the bias angle is to ensure a first electron impact near the channel entrance, reduce light feedback from the phosphor screen, and improve uniformity of the image transmission.

Etchable glass rods (cores) are clad with lead-silicate glass. After being drawn smaller, the clad rods are cut and fused into hexagonal array bundles. They are then drawn a second time, cut and fused into a boule, which is sliced into thin wafers, ground and polished to the final dimensions of the microchannel plate. The microchannels are obtained by etching the core glass from the lead-silicate glass structure.

The resistive secondary emission film covering the inside surface of the microchannels is obtained by hydrogen firing the MCP structure to reduce the lead-oxide glass to lead and water. The finely dispersed lead produces semiconduction in the lead oxide.

The inside surface of the microchannel electron multiplier is a continuous, resistive strip. By impressing a voltage across the microchannel, a homogeneous, axially-oriented electric field is produced in the channel. A primary electron, striking the input end of the channel, produces a multiple number of secondary electrons. The secondary electrons enter the axial electric field with a small, initial component of transverse velocity, causing the electrons to move on a parabolic path along the length of the channel until they collide with the channel wall again and generate more secondary electrons. The multiplication process continues until the end of the channel is reached.

If the electroding is extended into the channel at the output end, typically to a depth of one to three channel diameters, some collimation can be achieved. This process has been shown to improve resolution. It also destroys secondary emission where the electroding covers the walls, reducing the effective gain of the MCP by a few percent. End spoiling will not be necessary if a collimator is used near the screen.

MCPIs are the most significant element limiting the resolution of streak cameras. At present, the only method of increasing resolution for these applications is to use a larger diameter intensifier. This is a possible, though expensive, solution only for systems using 18 or 25 mm intensifiers, since 40 mm tubes are the largest available and cost about three times as much as 18 mm tubes.

It would be advantageous to prevent elastically-scattered electrons and electrons with high transverse energy from reaching the screen. This would improve dynamic range and spatial resolution of MCPIs.

SUMMARY OF THE INVENTION

It is an object of the present invention to include a collimator in a microchannel plate image intensifier (MCPI).

It is a further object of the invention to improve the resolution of a MCPI by eliminating scattered electrons and limiting the transverse energy of electrons reaching the MCPI screen.

A collimator is included in a microchannel plate image intensifier (MCPI). By inserting a collimator either in contact with or slightly above the phosphor screen, the following advantages are achieved. Electrons entering the collimator at an angle greater than the collimator acceptance angle will strike the collimator walls and be prevented front reaching the phosphor screen. The collimator angle can be adjusted to eliminate all of the elastically scattered electrons and to remove the electrons with transverse energies above any desired level.

The collimator angle is determined by the length-to-diameter ratio of the collimator and is easily controlled during the collimator manufacturing process, permitting any desired collimator acceptance angle. The smaller the collimator acceptance angle, the lower the transmission of the collimator and the smaller the spot size. This means that there is a trade-off between collimator efficiency and resolution of the tube. There is also a maximum efficiency of the collimator set by the open-area-ratio of the collimator, or the hole-to-wall-area ratio at the entrance surface. This can be about 75% to 80%. These factors reduce the number of electrons that get through the collimator to about 25% to 50% of those leaving the MCP.

Collimators can be useful in improving resolution of MCPIs by eliminating the scattered electron problem and by limiting the transverse energy of electrons reaching the screen. A collimator will also increase the extinction ratio of an intensifier by approximately an order of magnitude. Additionally, the smooth surface of the collimator will permit a higher focusing field to be employed in the MCP-to-collimator region than is currently permitted in the MCP-to-screen region by the relatively rough and fragile aluminum layer covering the screen. Coating the MCP and collimator surfaces with aluminum oxide appears to permit additional significant increases in the field strength, resulting in better resolution.

DETAILED DESCRIPTION OF THE INVENTION

Figure 1:
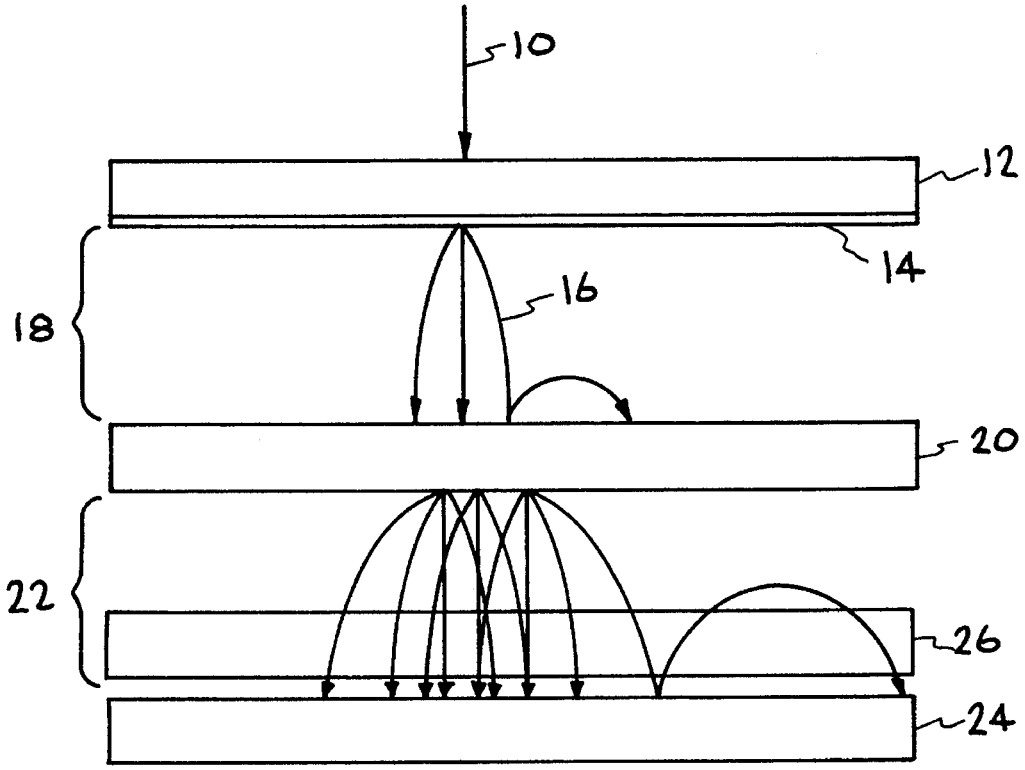
FIG. 1 shows a MCPI with a collimator.

The invention is a microchannel plate image intensifier (MCPI) with inclusion of a collimator. Light 10 enters at the top of FIG. 1, penetrates the faceplate 12 and strikes the photocathode 14. Some of the light 10 (photons) react with the photocathode 14 to liberate electrons 16, which enter the vacuum space (gap) 18 between the photocathode 14 and the MCP 20. This gap is sometimes referred to as a proximity-focusing electron lens. Electrons 16 are accelerated towards MCP 20 by an electric field in gap 18 between cathode 14 and MCP 20. The electrons have some initial transverse (sideways) energy as they leave the cathode causing them to take a parabolic path on their journey to MCP 20. This energy is in the order of between zero and about 0.1 ev and results in a spot on MCP 20 that is larger than the spot on photocathode 14 from which electrons 16 originated.

Most of the electrons reaching MCP 20 will enter holes in the MCP, be multiplied in numbers and exit the bottom of the MCP. The transverse energy of these electrons is about ten times as great as for the photocathode case mentioned above. The electrons enter gap 22 between MCP 20 and phosphor screen 24 and are accelerated towards phosphor screen 24 by an electric field in this gap. This gap is also referred to as a proximity-focusing electron lens. The spot on the screen is much larger than for the case mentioned above, due, in part, to the greater initial transverse energy of the electrons leaving the MCP.

The spot size on the screen is also proportional to the gap between the MCP and the screen and inversely proportional to the square-root of the voltage across the gap. To reduce the spot size (increase the resolution of the tube), the conventional approach has been to reduce the gap distance and increase the gap voltage. At some point the gap will break down, cause local heating and rip loose the aluminizing layer covering the phosphor, which usually ends up bridging the gap, shorting out and destroying the tube.

There is an additional factor that affects spot size. It is estimated that about 20% of the electrons are elastically scattered when they strike a surface. They rebound with their initial energy, are decelerated as they travel up towards their source, and then are pulled back down again by the electric field, striking the surface at a distance from their initial impact of up to two times the gap distance. In the screen region, this distance can be over two mm, resulting in a spot or halo diameter of over four mm. As a reference, the normal spot size of an average tube is about 0.045 mm. Although the intensity of this halo is low (about 0.1% of the peak intensity), it can degrade the performance of a tube where high dynamic range of brightness is important, e.g. looking at a dim object next to a bright object.

By inserting collimator 26 either in contact with or slightly above phosphor screen 24, as indicated in FIG. 1, the following advantages are achieved. Electrons entering collimator 26 at an angle greater than the collimator acceptance angle will strike the collimator walls and be prevented from reaching phosphor screen 24. The collimator angle can be adjusted to eliminate all of the elastically scattered electrons and to remove the electrons with transverse energies above any desired level.

The collimator angle is determined by the length-to-diameter ratio of the collimator and is easily controlled during the collimator manufacturing process, permitting any desired collimator acceptance angle. The smaller the collimator acceptance angle, the lower the transmission of the collimator and the smaller the spot size. This means that there is a trade-off between collimator efficiency and resolution of the tube. There is also a maximum efficiency of the collimator set by the open-area-ratio of the collimator, or the hole-to-wall-area ratio at the entrance surface, This can be about 75% to 80%. These factors reduce the number of electrons that get through the collimator to about 25% to 50% of those leaving the MCP.

The breakdown voltage is usually controlled by the roughness of the two opposing surfaces. In the case of the intensifier being discussed, this is usually controlled in the screen gap by the roughness of the aluminum layer on the phosphor screen and of the phosphor screen roughness itself. By inserting a smooth glass collimator as described, the screen roughness is isolated from the gap field and the breakdown is controlled by two smooth surfaces. This second collimator advantage will allow the electric field to be increased sufficiently to overcome the efficiency losses of the collimator. For example, if only 25% of the electrons get through the collimator, the effect will be to make the output image 25% as bright on the phosphor screen. By increasing the screen-MCP gap voltage from its normal 6,000V to 10,000V, the brightness loss can be recovered. Tests have confirmed that a voltage in excess of 10,000V can be sustained across a screen-MCP gap of less than 0.5 mm if a dielectric coating is applied to the MCP output surface.

The collimator will be manufactured using a process identical to that for standard MCPs, with some modifications. In the standard MCP process, a lead glass sleeve (the cladding) is placed over a glass rod (the core) and fused to the rod. The combination is heated and drawn into a fiber to reduce its diameter. The fiber is then cut into many equal lengths, bundled and then fused into a boule. The boule is heated and drawn into a fiber again (the second drawing), and the cutting, bundling and fusing process is repeated, resulting in a second boule composed of many tiny glass fibers which have a thin cladding glass surrounding them. The diameter of these tiny fibers is in the order of 10 μm at this point. Next, the boule is sliced at an angle of 5° to 7° from normal to the boule axis, into wafers about 0.4-mm thick. The wafers are placed into an echant which dissolves the core glass but not the cladding glass, leaving an array of 10 μm holes, called channels or pores, with 1 μm thick walls. This process turns the wafer into a MCP. Next the MCPs are activated by hydrogen firing to reduce the lead in the glass to free lead so that the walls of the channels are slightly conductive, permitting the establishment of an electric field gradient throughout the length of the channel when a voltage is applied across the MCP. Finally, electroding is deposited on the top and bottom sides of the MCP to provide for making electrical connection to the input and output of the MCP in order to permit establishing the internal electric field.

For a collimator, the above process is modified as follows. The second drawing is controlled to obtain the desired pore or channel diameter, which will be between 15 and 30 μm, depending upon the application. The pore length-to-diameter ratio determines the acceptance angle of the collimator. The minimum pore length is determined by practical considerations of handling the collimator, e.g. how thin a collimator can be before it breaks when it is picked up. This dimension is about 0.4 mm, which, along with the collimator acceptance angle, determines the required pore diameter.

The second modification is that the bias angle must be zero. The wafers are sliced perpendicularly to the boule axis.

The third modification is to reduce the glass during hydrogen firing as much as practical to make the pore walls as conductive as possible. This will reduce the possibility of collimator wall charging from electron collisions, which may affect the collimation factor—what percentage of the electrons get through.

The fourth modification is to apply the electroding over the entire collimator, including the edges, so that both surfaces remain at the same potential. This permits transfer of the potential applied to the screen of the intensifier to the entire collimator, ensuring that there is no field gradient across the collimator.

Figure 2:
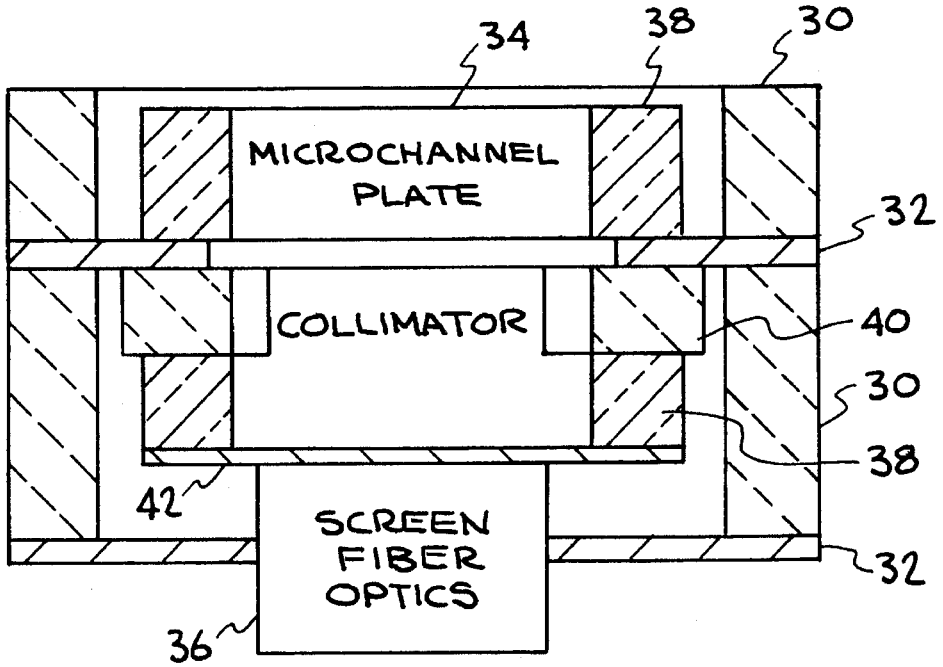
FIG. 2 shows the proximity of the collimator to the phosphor screen in one embodiment.

In one embodiment, the collimator is placed in close proximity to or in contact with the aluminization layer covering the phosphor screen of the MCP intensifier. Other implementations to accomplish the goal can be used. FIG. 2 shows a cross section of the edge of the MCP, collimator and screen section of an intensifier. The cathode section is not shown. Shown on the right are cemmic body sections 30 of the tube which are welded to the metal shoulder 32 which supports the MCP 34 and the screen fiber optics 36. The rim 38 (shaded areas of the MCP and Collimator) comprises solid glass areas used to reduce crushing of the channels near the edge of the wafer. A cemmic spacer 40, placed on a recessed shoulder of the collimator, is used to establish the collimator-to-MCP spacing. A thin conductive metal spacer 42 is used to establish a two or three micron separation between the collimator and screen. This spacer can be made by deposition of nickel or inconel onto the edge of the collimator near the rim.

Changes and modifications in the specifically described embodiments can be carried out without departing from the scope of the invention, which is intended to be limited by the scope of the appended claims.

I claim:

1. A microchannel plate image intensifier (MCPI), in an evacuated enclosure, comprising:

a photocathode for conversion of an incident radiant image to a low-energy electron image;

a microchannel plate for amplifying current from said electron image;

a phosphor screen for conversion of said electron image to a light image, wherein said microchannel plate is located between said photocathode and said phosphor screen; and a collimator fixedly placed between said microchannel plate and said phosphor screen, wherein said collimator is in proximity to said phosphor screen.

2. The MCPI of claim 1, further comprising a first proximity-focusing electron lens for focusing said electron image, wherein said first lens is located between said photocathode and said microchannel plate.

3. The MCPI of claim 2, further comprising a second proximity-focusing electron lens for focusing amplified current from said microchannel plate, wherein said second lens is located between said microchannel plate and said collimator.

4. The MCPI of claim 3, wherein said collimator does not touch said phosphor screen.

5. The MCPI of claim 3, wherein said collimator touches said phosphor screen.

6. The MCPI of claim 3, wherein said collimator has an adjustable acceptance angle.

7. The MCPI of claim 6, wherein said acceptance angle is adjusted to eliminate elastically scattered electrons and electrons with transverse energy.

8. In a microchannel plate image intensifier having, in an evacuated enclosure: a photocathode, a proximity focusing lens, a microchannel plate, a second proximity-focusing electron lens, and a phosphor screen, wherein said microchannel plate is located between said photocathode and said phosphor screen, the improvement comprising a collimator fixedly placed between said microchannel plate and said phosphor screen, wherein said collimator is in proximity to said phosphor screen.

9. A method of making a collimator for a microchannel plate image intensifier, the method comprising:

inserting a glass rod core into a lead glass sleeve;

fusing said lead glass sleeve to said glass rod;

simultaneously heating and drawing the product of said fusing step into a fiber to reduce its diameter;

cutting said fiber into many equal lengths;

bundling said lengths;

fusing the bundled lengths into a boule;

simultaneously heating and drawing said boule into a fiber, wherein said drawing is controlled to obtain a channel diameter of between 15 and 30 micrometers;

repeating said cutting, bundling and fusing steps to obtain a second boule;

slicing said second boule into wafers approximately 0.4 mm thick, wherein said second boule is sliced perpendicular to the boule axis such that said boule has a bias angle of zero;

dissolving said glass rod core in an echant, leaving only said lead glass sleeve said dissolving step producing a microchannel plate;

hydrogen firing said microchannel plate to free the lead in said glass rod to make the channels as conductive as possible; and applying an electrode laser over the entire collimator.

* * * * *